US011011865B2

(12) United States Patent
Maesoba et al.

(10) Patent No.: US 11,011,865 B2
(45) Date of Patent: May 18, 2021

(54) CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/629,158

(22) PCT Filed: Jun. 20, 2018

(86) PCT No.: PCT/JP2018/023447
§ 371 (c)(1),
(2) Date: Jan. 7, 2020

(87) PCT Pub. No.: WO2019/012932
PCT Pub. Date: Jan. 17, 2019

(65) Prior Publication Data

US 2020/0136294 A1 Apr. 30, 2020

(30) Foreign Application Priority Data

Jul. 11, 2017 (JP) ..... JP2017-135246

(51) Int. Cl.
*H01R 13/40* (2006.01)
*H01R 13/428* (2006.01)
*H01R 13/436* (2006.01)

(52) U.S. Cl.
CPC ..... *H01R 13/428* (2013.01); *H01R 13/4364* (2013.01); *H01H 2231/026* (2013.01)

(58) Field of Classification Search
USPC ..... 439/744
See application file for complete search history.

(56) References Cited

U.S. PATENT DOCUMENTS 5,683,272 A 11/1997 Abe
10,424,872 B2 * 9/2019 Van Den Brink ... H01R 13/642
(Continued)

FOREIGN PATENT DOCUMENTS

JP 61-133978 8/1986
JP 8-096864 4/1996
(Continued)

OTHER PUBLICATIONS

International Search Report dated Sep. 11, 2018.

*Primary Examiner* — Abdullah A Riyami
*Assistant Examiner* — Nelson R. Burgos-Guntin
(74) *Attorney, Agent, or Firm* — Gerald E. Hespos; Michael J. Porco; Matthew T. Hespos

(57) ABSTRACT

It is aimed to provide a connector capable of reducing the number of components. A connector (100) includes a plurality of terminal fittings (50) having wires (90) connected to rear end parts, and a dielectric (20) for accommodating the plurality of terminal fittings (50) with the wires (90) drawn out rearward. The dielectric (20) includes a holding member (30) having a plurality of terminal accommodation chambers (34) separated in two upper and lower stages and laterally arranged in parallel, upper and lower surfaces of the holding member (30) being formed with openings (35) enabling the terminal fittings (50) to be mounted into the terminal accommodation chambers (34), and a front member (40) integrally formed with a pair of upper and lower closing portions (41, 41) for individually closing the openings (35) on an upper
(Continued)

surface side and the openings (35) on a lower surface side, the front member (40) being assembled with the holding member (30) from front.

7 Claims, 17 Drawing Sheets

(56) References Cited

U.S. PATENT DOCUMENTS

2002/0045380 A1* 4/2002 Endo ..... H01R 13/6272 439/489
2007/0004274 A1* 1/2007 Tabata ..... H01R 13/514 439/540.1
2007/0059970 A1* 3/2007 Ichio ..... H01R 13/6272 439/382
2007/0149041 A1* 6/2007 Fujii ..... H01R 13/641 439/489
2007/0249223 A1* 10/2007 Sakamoto ..... H01R 13/5221 439/552
2008/0009171 A1* 1/2008 Tsuji ..... H01R 13/6272 439/352
2008/0057774 A1* 3/2008 Yoshida ..... H01R 13/64 439/374
2009/0042445 A1* 2/2009 Ichio ..... H01R 13/514 439/626
2010/0136819 A1* 6/2010 Mase ..... H01R 13/743 439/345
2010/0136842 A1* 6/2010 Sakamoto ..... H01R 13/521 439/639
2011/0053403 A1* 3/2011 Tsuruta ..... H01R 13/6215 439/345
2011/0230086 A1* 9/2011 Fujiwara ..... H01R 13/6584 439/559
2013/0012042 A1* 1/2013 Takeda ..... H01R 13/4365 439/137
2013/0288542 A1 10/2013 Zheng et al.
2014/0045378 A1* 2/2014 Kawashima ..... H01R 13/506 439/607.58
2015/0037995 A1* 2/2015 Saitou ..... H01R 13/62 439/310
2015/0079827 A1* 3/2015 Hara ..... H01R 13/46 439/188
2015/0140847 A1* 5/2015 Kanemura ..... H01R 13/62938 439/259
2015/0333427 A1* 11/2015 Taguchi ..... H01R 13/428 439/748
2016/0036156 A1* 2/2016 Iihoshi ..... H01R 13/5202 439/587
2016/0064851 A1* 3/2016 Kataoka ..... H01R 13/5208 439/587
2016/0248194 A1* 8/2016 Ii ..... H01R 13/4223
2017/0309420 A1 10/2017 Iwamoto
2018/0026389 A1* 1/2018 Kida ..... H01R 13/03 439/536
2018/0026391 A1* 1/2018 Kida ..... H01R 13/62955 439/587
2019/0148882 A1* 5/2019 Kosaka ..... H01R 13/62955 439/372
2019/0190211 A1* 6/2019 Yamanashi ..... H01R 13/6592
2019/0207347 A1* 7/2019 Maesoba ..... H01R 13/648
2019/0273338 A1* 9/2019 Oka ..... H01R 13/5208
2020/0136294 A1* 4/2020 Maesoba ..... H01R 13/4364
2020/0144755 A1* 5/2020 Matsuura ..... H01R 13/502
2020/0176917 A1* 6/2020 Zhou ..... H01R 13/432
2020/0185843 A1* 6/2020 Miyamura ..... H01R 13/41
2020/0212617 A1* 7/2020 Miyamura ..... H01R 13/4223

FOREIGN PATENT DOCUMENTS

JP 8-148194 6/1996
JP 2013-229224 11/2013
JP 2016-054057 4/2016
WO 2016-080064 5/2016

* cited by examiner

CONNECTOR

BACKGROUND

Field of the Invention

The invention relates to a connector.

Related Art

Japanese Unexamined Patent Publication No. 2013-229224 discloses a connector that includes terminal fittings to be crimped to end parts of wires and a housing having cavities for accommodating the terminal fittings. Each terminal fitting is inserted into the cavity from behind, and the properly inserted terminal fitting is resiliently retained by a locking lance integrally formed to the inner surface of the cavity.

In the connector of Japanese Unexamined Patent Publication No. 2013-229224, the locking lance interferes with the terminal fitting and is deflected and deformed in a vertical direction when the terminal fitting is inserted into the cavity. Thus, a deflection space into which the deflected locking lance enters is formed below the locking lance in the housing. Since the deflection spaces are arranged downward of the cavities, the housing is enlarged in the vertical direction.

To omit a retaining configuration by locking lances, it is considered to provide cavities with openings open upward and to insert terminal fittings into the cavities from above. In the configuration in which the terminal fittings are inserted into the cavities from above, the openings need to be closed from above to prevent the withdrawal of the terminal fittings. However, in the case of accommodating the terminal fittings respectively into the cavities arranged in upper and lower stages as in the connector of Japanese Unexamined Patent Publication No. 2013-229224, a closing member for closing the openings of the cavities in the upper stage and a closing member for closing the openings of the cavities in the lower stage are necessary as individual components. This causes a problem of increasing the number of components constituting the connector.

The invention was completed on the basis of the above situation and aims to provide a connector capable of reducing the number of components.

SUMMARY

The invention is directed to a terminal fitting with terminal fittings having wires connected to rear end parts, and a dielectric for accommodating the terminal fittings with the wires drawn out rearward. The dielectric includes a holding member having terminal accommodation chambers separated in upper and lower stages and laterally arranged in parallel. Upper and lower surfaces of the holding member are formed with openings enabling the connector to be mounted into the terminal accommodation chambers. A front member is formed integrally with upper and lower closing portions for individually closing the openings on an upper surface side and the openings on a lower surface side. The front member is assembled with the holding member from the front.

The front member is assembled with the holding member from the front and is formed integrally with the upper and lower closing portions for individually closing the openings on the upper surface and the openings on the lower surface. Thus, only the front member may be used to close the openings on the upper surface and the openings on the lower surface without using individual closing members, and the number of components can be reduced.

The holding member may include side walls defining the terminal accommodation chambers. The side walls may be formed with restricting projections for locking the terminal fittings in the terminal accommodation chambers to restrict withdrawal from the openings. According to this configuration, the withdrawal of the terminal fittings from the terminal accommodation chambers before the front member is assembled with the holding member can be prevented by locking the terminal fittings mounted into the terminal accommodation chambers by the restricting projections to restrict the withdrawal from the openings.

The restricting projections may be disposed to lock front parts of the terminal fittings. According to this configuration, the restricting projections lock the front parts of the terminal fittings. Thus, the escape of at least the front parts of the terminal fittings from the terminal accommodation chambers can be restricted before the front member is assembled with the holding member. Thus, when the front member is assembled with the holding member from the front, the front parts of the terminal fittings escaping from the terminal accommodation chambers interfere with the front member to hinder assembling.

The front member may include left and right side plates connected to both left and right ends of the upper and lower closing portions for covering both left and right side surfaces of the holding member. The front member may be cut forward from a rear end to form a slit. Thus, a part of the side plate serves as a resilient locking piece resiliently deformable in a lateral direction and lockable to the holding member. According to this configuration, the part of the side plate of the front member serves as the resilient locking piece resiliently deformable in the lateral direction. Thus, assembling resistance in assembling the front member with the holding member from the front can be reduced by the resilient locking piece being deflected in the lateral direction.

The holding member may be formed with a rib for filling up the slit by entering the slit. According to this configuration, the intrusion of an external matter into the slit formed in the front member can be prevented with the front member assembled with the holding member. In this way, the resilient locking piece constituting a part of the slit can be prevented from being improperly deformed due to interference with an external matter having entered the slit or the like.

A front surface of the dielectric may be formed with insertion holes for allowing the insertion of tabs of mating terminals into the terminal accommodation chambers. Each insertion hole may be composed of a cutout formed by cutting a front wall of the holding member to communicate with the opening and a recess formed in a front part of the closing portion. If the insertion holes formed in the front surface of the dielectric are formed only by the front wall of the holding member, edge parts of the insertion holes are formed partially by elongated beams defining the insertion holes and the openings and the beams may be broken. As a countermeasure against this, parts (recesses) of the insertion holes closest to the openings are formed by the closing portions. This eliminates the need for leaving the elongated beams in the holding member and solves a problem of breakage.

DETAILED DESCRIPTION

First Embodiment

A first embodiment of the invention is described with reference to FIGS. 1 to 15. Note that, in the following description, a left side in FIGS. 1 to 4 and 6 to 15 is defined as a front concerning a front-rear direction. Upper and lower sides shown in FIGS. 1 to 5 and 8 to 15 are defined as upper and lower sides concerning a vertical direction. Left and right sides shown in FIG. 5 are defined as left and right sides concerning a lateral direction.

Figure 1:
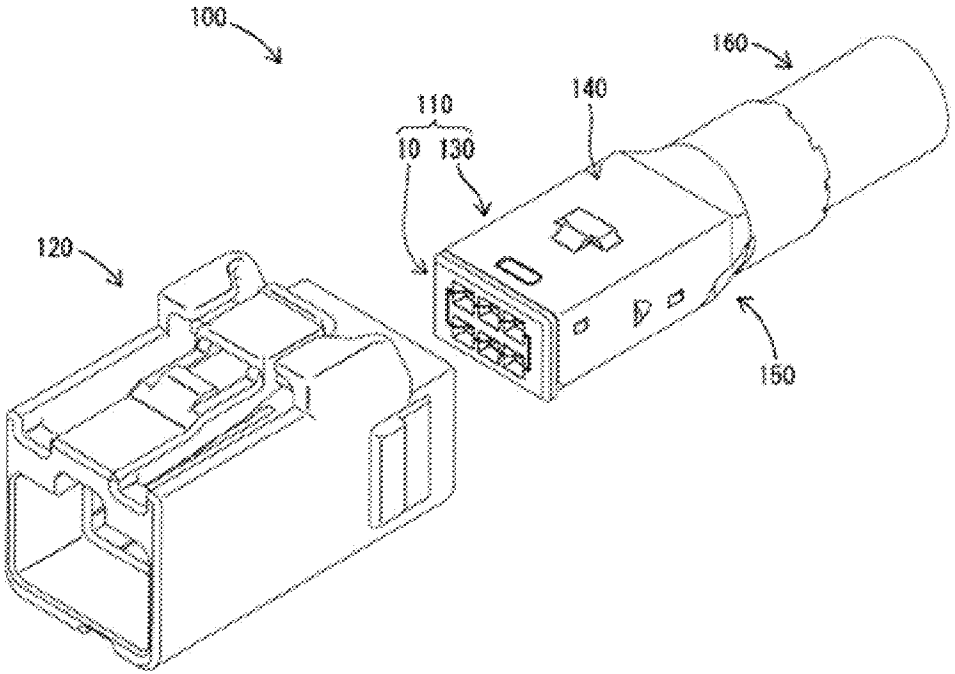
FIG. 1 is a perspective view showing a state where a housing and a shield terminal are separated in a connector of a first embodiment when viewed obliquely from above.
Figure 2:
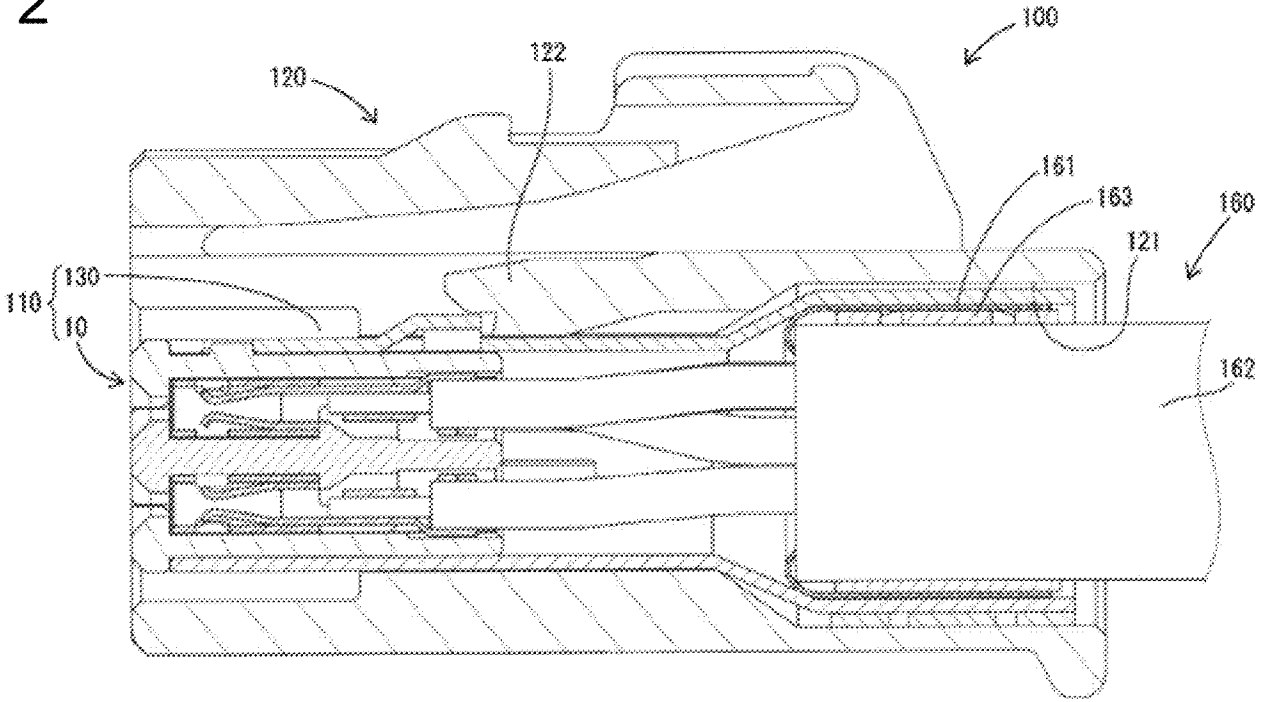
FIG. 2 is a side view in section of the connector having a cable mounted therein.
Figure 3:
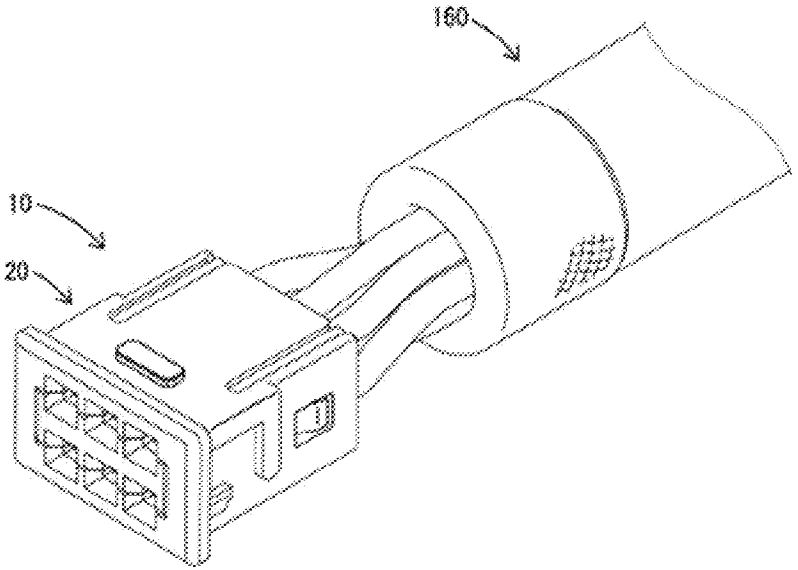
FIG. 3 is a perspective view of a terminal unit and a part of the cable.
Figure 7:
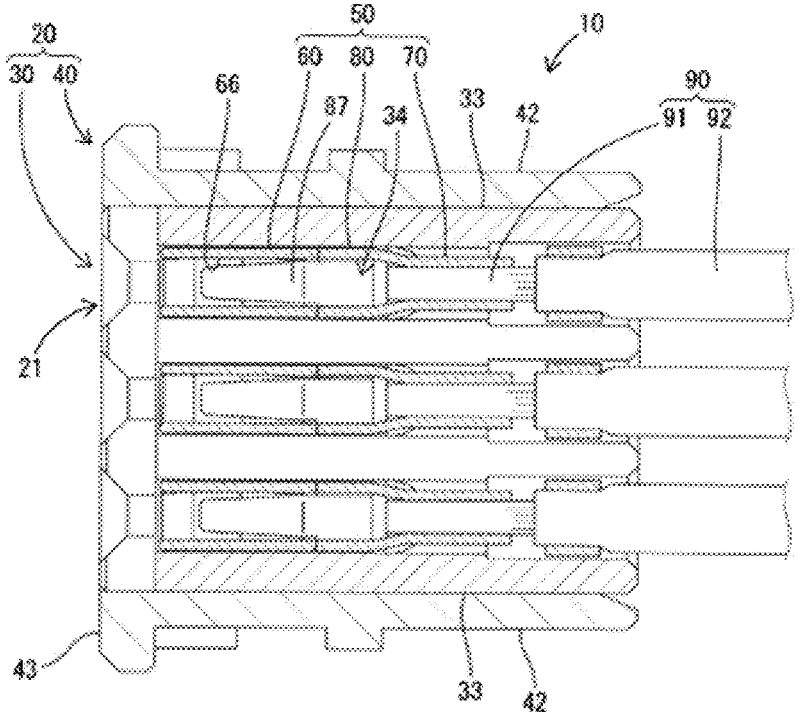
FIG. 7 is a section along B-B of FIG. 5.

A connector 100 of the first embodiment is a connecting member of a wiring harness for high-speed communication circuit of an automotive vehicle. As shown in FIGS. 1 and 2, the connector 100 includes a shield terminal 110 and a housing 120 for accommodating the shield terminal 110. The shield terminal 110 is configured by surrounding a terminal unit 10 by an outer conductor 130. As shown in FIG. 7, the terminal unit 10 is configured by accommodating terminal fittings 50 into a dielectric 20.

As shown in FIG. 2, an accommodation chamber 121 is formed inside the housing 120, and the shield terminal 110 is inserted into the accommodation chamber 121 from behind the housing 120. A locking lance 122 is cantilevered forward from the inner upper surface of the accommodation chamber 121 and is resiliently deflectable upward.

As shown in FIG. 1, the shield terminal 110 includes the terminal unit 10 and the outer conductor 130. The terminal unit 10 includes the dielectric 20 and the terminal fittings 50. The terminal fittings 50 are crimped to end parts of a cable 160 and are accommodated in the dielectric 20, as shown in FIG. 7.

The cable 160 is a multi-core cable in which plural wires 90 are surrounded collectively by a braided wire 161 and a sheath 162. The wires 90 are drawn out in a branched manner from end parts of the braided wire 161 and the sheath 162. A sleeve 163 made of metal is fit externally on an end part of the sheath 162, and an end part of the braided wire 161 exposed to outside from the end part of the sheath 162 is folded back rearward and overlapped on the outer periphery of the sleeve 163. An axial direction of the wires 90 is parallel to the front-rear direction and orthogonal to the vertical direction and the lateral direction.

Figure 8:
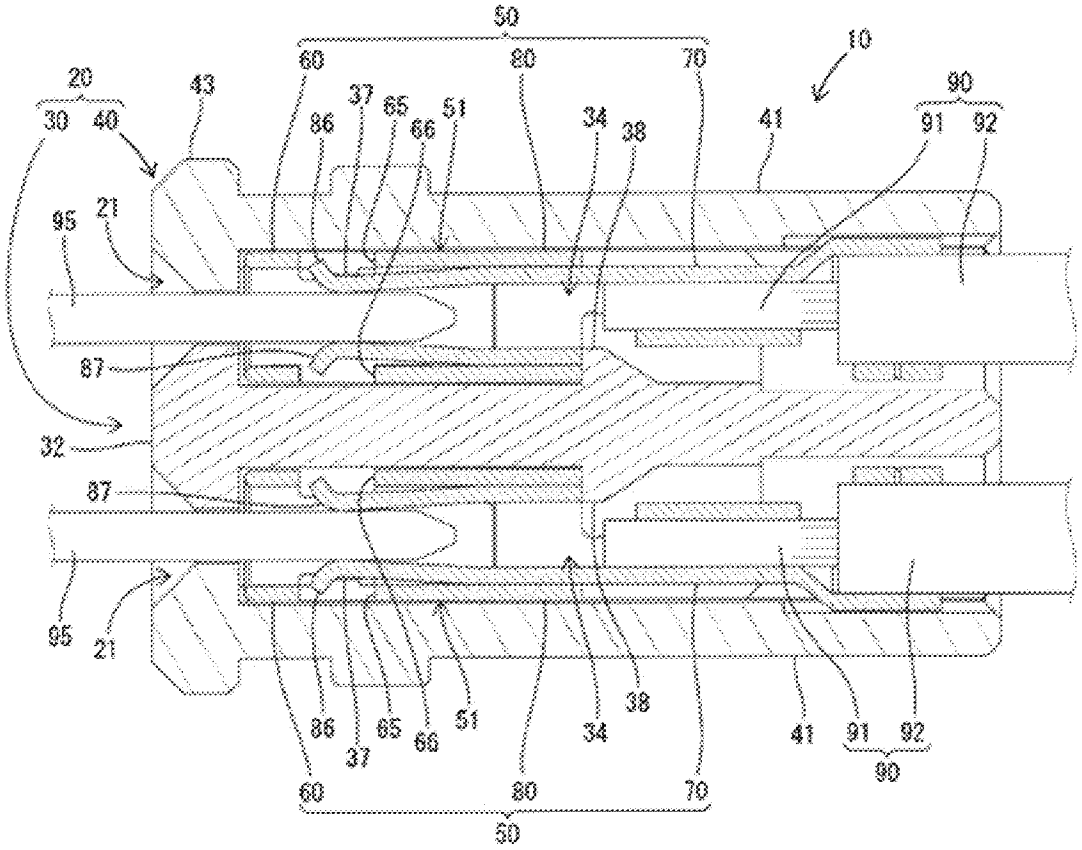
FIG. 8 is a section along C-C of FIG. 5 in a state where tabs of mating terminals are inserted.

As shown in FIGS. 7 and 8, the dielectric 20 accommodates the terminal fittings 50 with the wires 90 drawn out rearward. The front surface of the dielectric 20 is formed with insertion holes 21 for allowing the insertion of tabs 95 of mating terminals into terminal accommodation chambers 34 to be described later. As shown in FIGS. 4 to 8, the dielectric 20 includes a holding member 30 into which the terminal fittings 50 are mounted, and a front member 40 to be assembled with the holding member 30 from the front.

Figure 9:
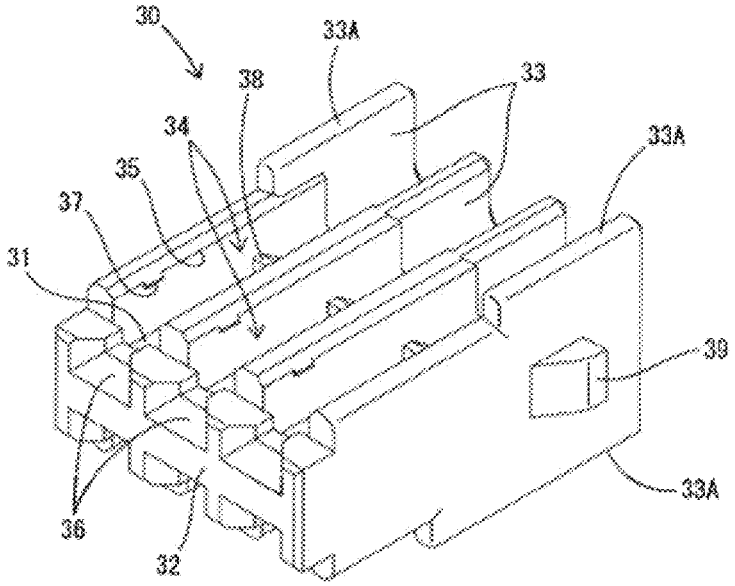
FIG. 9 is a perspective view of a holding member.

As shown in FIG. 9, the holding member 30 includes a substantially rectangular base plate 31, a front wall 32 substantially orthogonally connected to a front part of the base plate 31 to extend up and down, and four side walls 33 substantially orthogonally connected to the base plate 31 to extend up and down. The holding member 30 includes terminal accommodation chambers 34 separated in upper and lower stages and laterally arranged in parallel. The terminal accommodation chambers 34 are defined as long grooves extending in the front-rear direction by the front wall 32 and the four side walls 33. The upper and lower surfaces of the holding member 30 are formed respectively with openings 35 enabling the terminal fittings 50 to be mounted into the terminal accommodation chambers 34. The front wall 32 of each terminal accommodation chamber 34 is formed with a cutout 36 communicating with the opening 35. The cutout portion 36 has a tapered shape so that a cutout width (cutout area) becomes smaller toward the rea.

A restricting projection 37 to be locked to a front end part of the terminal fitting 50 (both left and right edges of a cutout 66) is formed on a surface of the side wall 33 facing each terminal accommodation chamber 34. Each restricting projection portion 37 restricts the withdrawal of the terminal fitting 50 from the opening 35 by being locked to the terminal fitting 50 in the terminal accommodation chamber 34. A rib 33A extends up from a rear end on the side wall 33 on an upper stage, and a rib 33A extends down from a rear end side on the lower side wall 33 on a lower stage. The base plate 31 is formed with movement restricting portions 38 for restricting rearward movements of the terminal fittings 50 by contacting the terminal fittings 50 while projecting inward of the respective terminal accommodation chambers 34. Locking projections 39 to be locked to the front member 40 to be described later are formed respectively on both left and right outer side surfaces of the holding member 30 (outer surfaces of the side walls 33).

Figure 10:
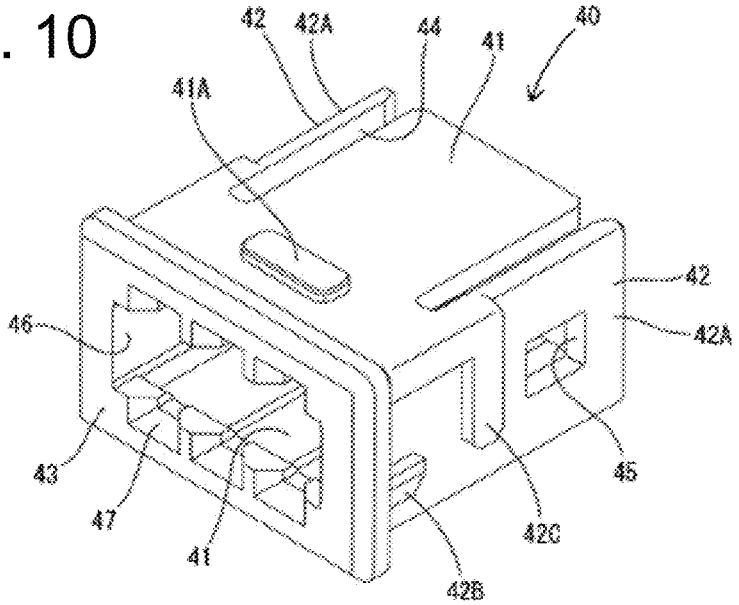
FIG. 10 is a perspective view of a front member.

As shown in FIG. 10, the front member 40 is a single component with upper and lower closing portions 41, 41, left and right side plates 42, 42 and a front wall 43. The upper and lower closing portions 41, 41 are integrated via the left and right side plates 42, 42 and individually close the openings 35 on an upper surface side and the openings 35 on a lower surface side in the holding member 30. The left and right side plates 42, 42 are connected to both left and right ends of the upper and lower closing portions 41, 41 and cover both left and right side surfaces of the holding member 30. The front wall 43 is connected substantially orthogonally to front end parts of the closing portions 41, 41 and front end parts of the side plates 42, 42. The front member 40 is formed with slits 44 by cutting boundary parts between the closing portions 41 and the side plates 42 (four corner parts of the front member 40) forward from a rear end part. The slits 44 are filled up by the ribs 33A of the holding member 30 fit therein. The closing portion 41 is formed with an upwardly projecting locking portion 41A to be locked to a first shell 140 to be described later.

Areas of the side plates 42, 42 formed with the slits 44 in the front-rear direction (parts rearward of a position closer to a front end than a center in the front-rear direction) serve as resilient locking pieces 42A resiliently deformable in the lateral direction and lockable to the locking projections 39 of the holding member 30. A locking hole 45 penetrates each side plate 42 in a plate thickness direction and the locking projection 39 of the holding member 30 is locked thereto. The side plate 42 also is formed with outward projecting locking portions 42B, 42C to be locked to a second shell 150 to be described later.

A through hole 46 penetrates through a central part of a wall surface of the front wall portion 43 in the front-rear direction and the front wall 32 of the holding member 30 is inserted therein. The through hole 46 is formed with three recesses 47 by cutting an upper edge part (front end part of the upper closing portion 41) upward and three recesses 47 by cutting a lower edge part (front end part of the lower closing portion 41) downward. Each recess 47 is formed into a tapered shape so that a cutout width (cutout area) becomes smaller toward the rear.

The terminal fitting 50 is a female terminal fitting and is formed integrally by applying bending and the like after a conductive metal plate is stamped. As shown in FIGS. 7, 8 and 11 to 13, the terminal fitting 50 is elongated in the front-rear direction, and includes a box 60, a crimping portion 70 and a coupling portion 80. The box 60 is shaped to be elongated in the front-rear direction and is in the form of a rectangular tube accommodating to resilient contact pieces 86, 87 to be described later. The crimping portion 70 is crimped to the outer periphery of the wire 90. The coupling portion 80 is a rectangular tube formed with the two resilient contact pieces 86, 87 and coupling a rear end of the box 60 and a front end of the crimping portion 70. A terminal body 51 is constituted by the box 60 and the coupling portion 80. If the tab 95 of the mating terminal is inserted into the box 60 from the front (see FIG. 8), the resilient contact pieces 86, 87 contact the tab 95 of the mating terminal while resiliently sandwiching the tab 95 so that the mating terminal and the terminal body 51 are connected conductively.

A cutout 65 penetrates an upper plate of the box 60 in the plate thickness direction. The resilient contact piece 86 enters the cutout 65 during deformation, thereby avoiding the interference of a front end part (extending end part) of the resilient contact piece 86 with the box 60. The cutout 66 penetrating in the plate thickness direction is formed in a lower plate of the box 60. The resilient contact piece 87 enters the cutout portion 66 during deformation, thereby avoiding the interference of a front part (extending end part) of the resilient contact piece 87 with the box 60.

As shown in FIGS. 7 and 8, the crimping portion 70 is crimped and connected conductively to a tip part of the wire 90. The crimping portion 70 includes a wire barrel 71 to be crimped to a core 91 at the tip part of the wire 90 and an insulation barrel 72 located behind the wire barrel 71 and to be crimped to a coating 92 of the wire 90.

As shown in FIGS. 7 and 8, the coupling portion 80 includes a body 81 and the resilient contact pieces 86, 87. The body 81 is a rectangular tube. The resilient contact piece 86 is a long plate connected to a front part of an upper plate of the body 81 and extending forward. The resilient contact piece 87 is in the form of a long plate connected to a front part of a lower plate of the body 81 and extending forward.

As shown in FIG. 1, the outer conductor 130 is configured by uniting the first shell 140 in a halved state and the second shell 150 in a halved state to sandwich the terminal unit 10. An upper barrel 143 and a lower barrel 153 formed on a rear end part of the outer conductor 130 are fixed conductively to the braided wire 161 of the cable 160. The shield terminal 110 fixed to the wires 90 is assembled by being inserted into the housing 120 from behind.

The first shell 140 includes an upper plate 142 in the form of a long plate, left and right side plates 142 connected substantially at a right angle to both left and right sides of the upper plate 141 and the upper barrel 143 in the form of an open barrel. A first locking portion 144 to be locked to the housing 120 is formed in a substantially central part of the upper plate 141 by cutting and raising a part of the upper plate portion 141 to project upward. An upper locking hole 145 is formed in front of the first locking portion 144 of the upper plate 141 and penetrates in the plate thickness direction for locking to the front member 40. A second locking portion 146 to be locked to the housing 120 is formed in a substantially central part of the side plate portion 142 by cutting and raising a part of the side plate 142 to project outward. A third locking portion 147 to be locked to the front member 40 is formed in front of the second locking portion 146 in the side plate 142 by cutting and raising a part of the side plate 142 to project inward. A fourth locking portion 148 to be locked to the second shell 150 is formed behind the second locking portion 146 in the side plate 142 by cutting and raising a part of the side plate 142 to project inward.

The second shell 150 includes a lower plate 151 in the form of a long plate, left and right side plates 152 connected substantially at a right angle to both left and right side edges of the lower plate 151 and the lower barrel 153 in the form of an open barrel. A first cutout 154 is formed as a cut extending rearward in a front part of the side plate 152. A second cutout 155 is formed as a cut extending downward behind the first cutout 154 in the side plate 152. A second through hole 156 penetrating in the plate thickness direction is formed behind the second cutout 155 in the side plate 152.

Figure 11:
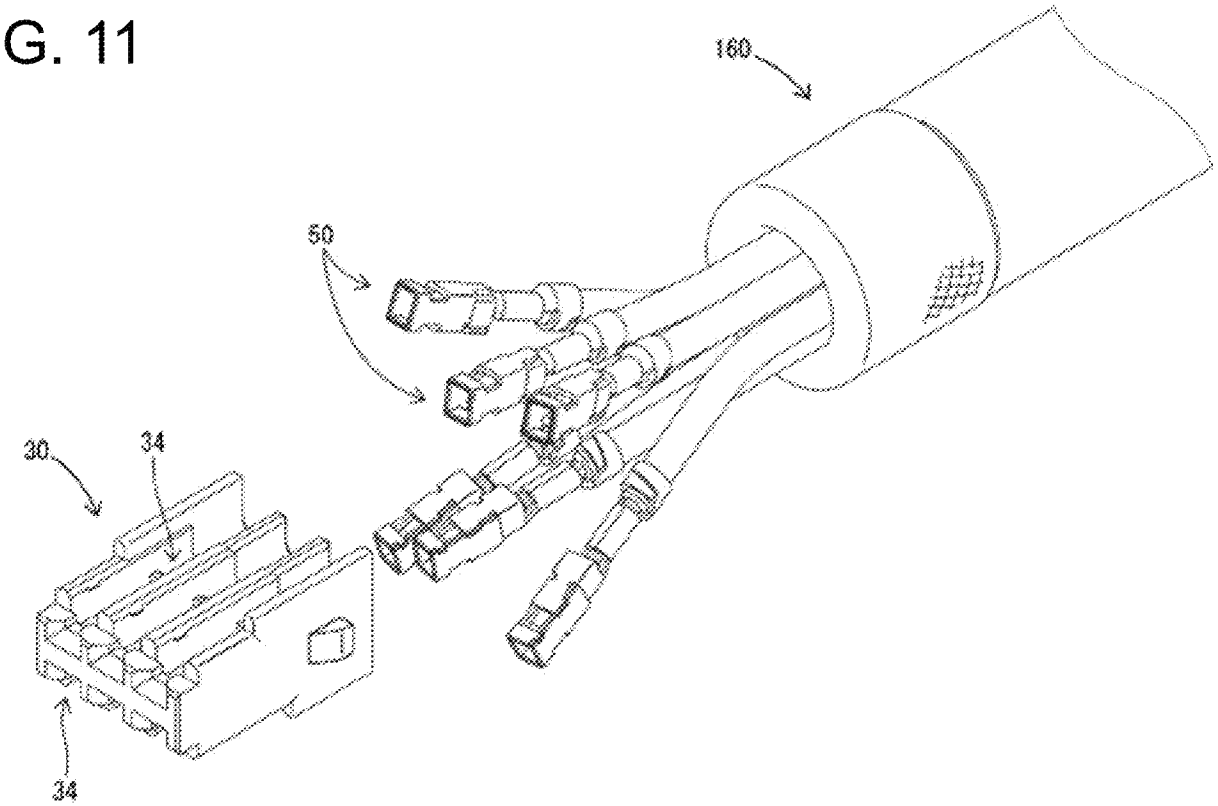
FIG. 11 is a perspective view showing a state before terminal fittings are mounted into the holding member when viewed obliquely from above.
Figure 12:
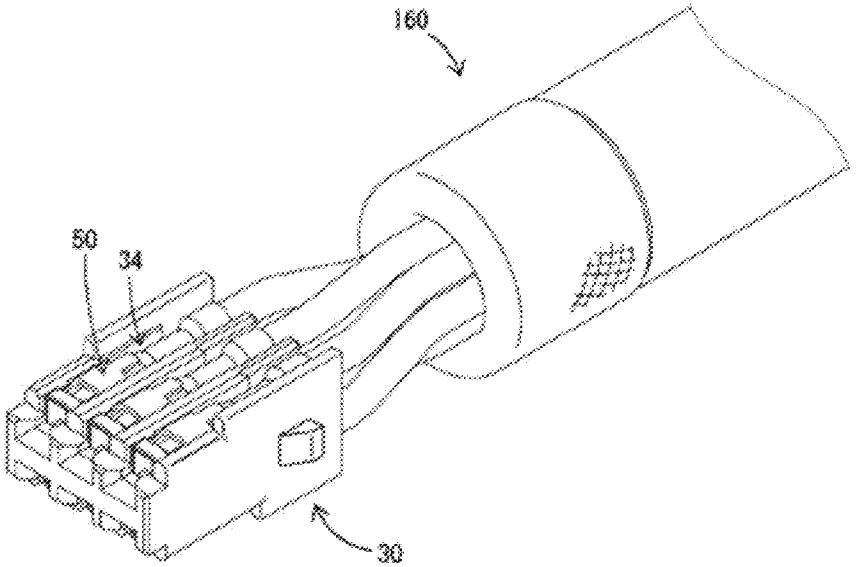
FIG. 12 is a perspective view showing a state where the terminal fittings are mounted in the holding member when viewed obliquely from above.
Figure 13:
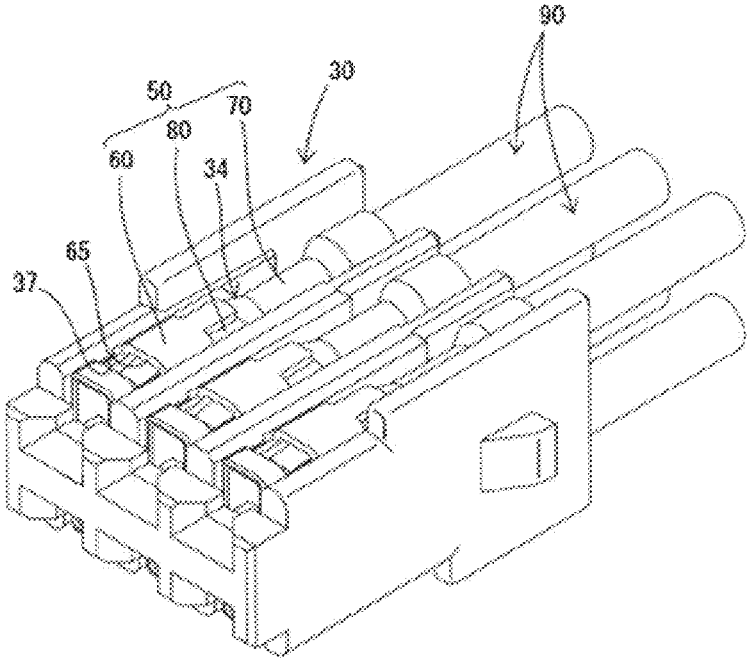
FIG. 13 is a partial enlarged view of FIG. 12.
Figure 14:
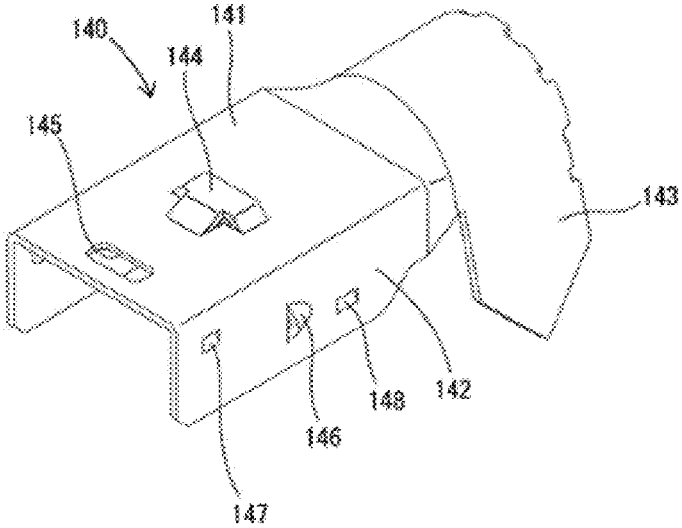
FIG. 14 is a perspective view of a first shell.
Figure 15:
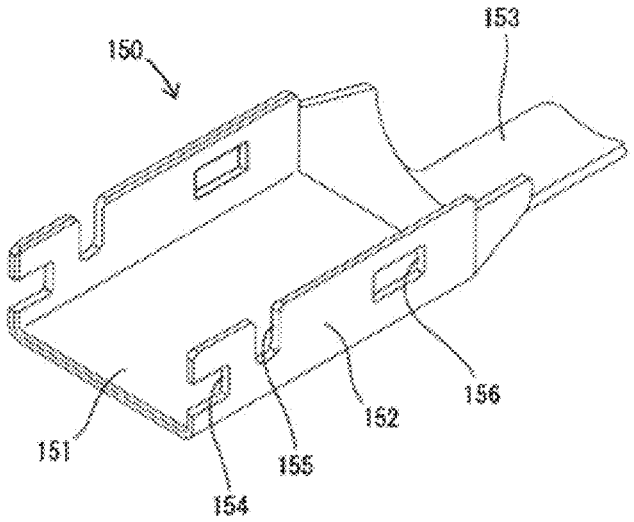
FIG. 15 is a perspective view of a second shell.

As shown in FIGS. 11 to 13, the terminal fittings 50 configured as described above are mounted into the holding member 30 from above or below. Three terminal fittings 50 respectively enter three terminal accommodation chambers 34 in the upper stage of the holding member 30 via the openings 35 from above. Three terminal fittings 50 respectively enter three terminal accommodation chambers 34 in the lower stage of the holding member 30 via the openings 35 from below. Each terminal fitting 50 entering the terminal accommodation chamber 34 in the lower stage is in a posture vertically inverted from the posture of the terminal fittings 50 entering the terminal accommodation chambers 34 in the upper stage. Two of the restricting projections 37 are locked to the front part of the terminal fitting 50 (both left and right edges of the cutout portion 66) in the terminal accommodation chamber 34 in the upper stage from above, and two of the restricting projections 37 are locked to the front part of the terminal fitting 50 (both left and right edge of the cutout portion 66) in the terminal accommodation chamber 34 in the lower stage from below. The restricting projects 37 prevent withdrawal of the terminal fitting 50 in the terminal accommodation chamber 34 from the opening 35. A rear part of the terminal body 51 is locked to the movement restricting portion 38 from the front to restrict a rearward movement of the terminal body portion 51 of the terminal fitting 50 in the terminal accommodation chamber 34.

Figure 4:
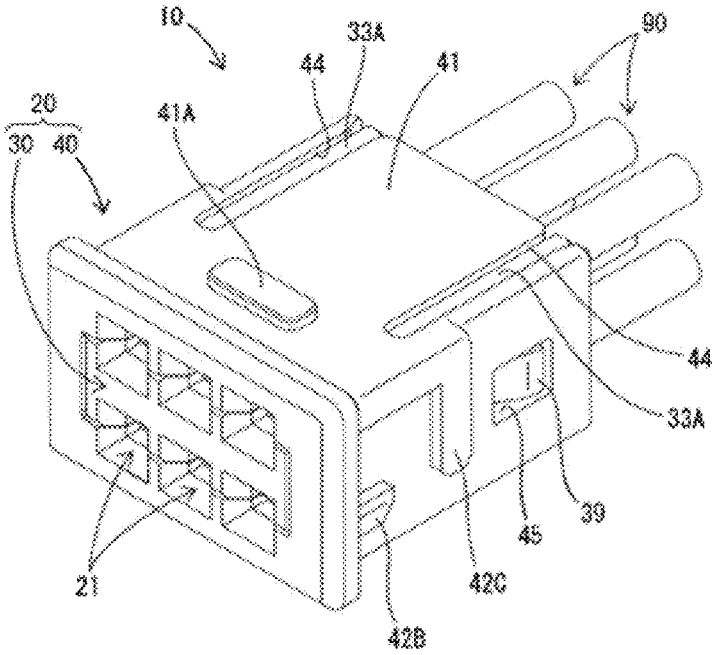
FIG. 4 is a perspective view of the terminal unit and parts of wires
Figure 5:
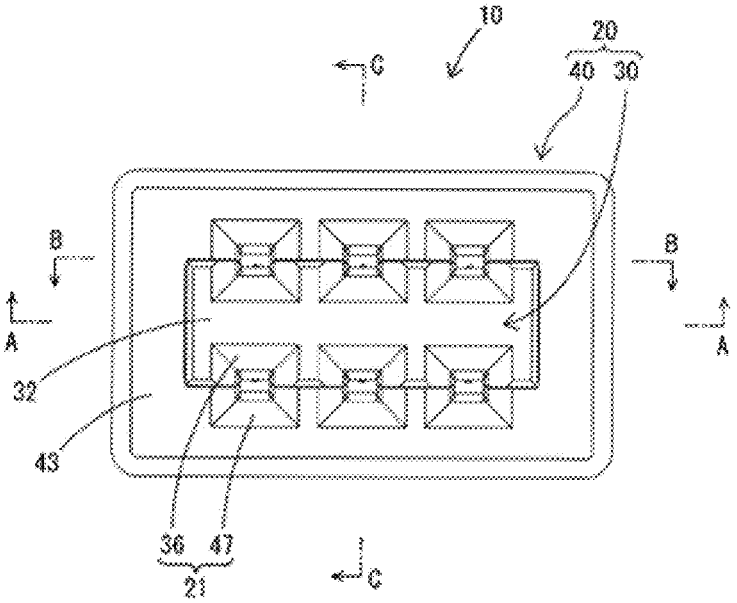
FIG. 5 is a front view of the terminal unit.
Figure 6:
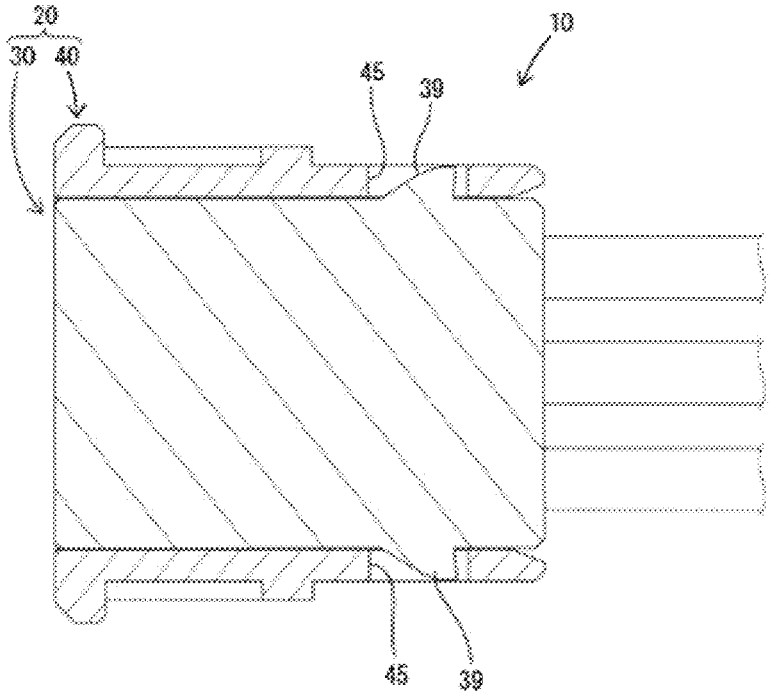
FIG. 6 is a section along A-A of FIG. 5.

As shown in FIGS. 3 to 8, the front member 40 is assembled from the front with the holding member 30 having the terminal fittings 50 mounted therein to configure the terminal unit 10. In an assembling process, the left and right resilient locking pieces 42A, 42A of the front member 40 interfere with the locking projections 39 to deform resiliently leftward and rightward, and the holding member 30 enters the inside of the front member 40. When the assembling is completed, the ribs 33A enter the slits 44 of the front member 40 to fill up clearances, as shown in FIG. 4. The locking projections 39 of the holding member 30 enter the locking holes 45 of the front member 40 and the resilient locking pieces 42A resiliently restore. The upper closing portion 41 closes the three openings 35 on the upper surface side of the holding member 30 from above, and the lower closing portion 41 closes the three openings 35 on the lower surface side of the holding member 30 from below. Six terminal fittings 50 are accommodated into the dielectric 20 to complete the terminal unit 10.

The front member 40 is formed integrally with the upper and lower closing portions 41, 41 for individually closing the openings 35 on the upper and lower surfaces. Thus, it is not necessary to use separate components for closing the openings 35 on the upper and lower surfaces. Thus, the number of components constituting the connector 100 can be reduced. In the case of using separate components for respectively closing the openings 35 on the upper surface side and the openings 35 on the lower surface side, each component has a vertical dimensional tolerance. Thus, a vertical dimensional tolerance becomes larger and clearances may be formed between components in the vertical direction and rattling may occur. The connector 100 of this embodiment is configured to close the openings 35 on the upper and lower surfaces by only one component (front member 40). Thus, an accumulated vertical dimensional tolerance is small, clearances are hardly formed between the components in the vertical direction and rattling hardly occurs.

As shown in FIGS. 4 and 5, the insertion holes 21 are formed by the cutouts 36 of the holding member 30 and the recesses 47 of the front member 40. The insertion hole 21 is tapered so that an opening area becomes smaller toward the rear. Thus, the tab 95 of the mating terminal is guided toward a center of an opening area of the insertion hole 21 by contacting the insertion hole 21.

The shield terminal 110 is configured by assembling the outer conductor 130 with the terminal unit 10. The second shell 150 is assembled with the terminal unit 10. The locking portions 42B, 42C of the front member 40 respectively enter the first and second cutouts 154, 155 of the second shell 150 for locking. After the second shell 150 is assembled with the terminal unit 10, the first shell 140 is assembled with the second shell 150 and the terminal unit 10. The locking portion 41A of the front member 40 enters the upper locking hole 145 of the first shell 140 for locking. The third locking portions 147 of the first shell 140 contact the locking portions 42C of the front member 40 from below for locking. The fourth locking portions 148 of the first shell 140 enter the second through holes 156 of the second shell 150 for locking. The terminal unit 10, the first shell 140 and the second shell 150 are held united, and the shield terminal 110 is completed.

By inserting the shield terminal 110 into the housing 120 from behind, as shown in FIGS. 1 and 2, the shield terminal 110 is accommodated in the housing 120 and the connector 100 is completed.

When a mating connector is connected to the connector 100, the tabs 95 of the mating terminals inserted into the insertion holes 21 are inserted into the terminal accommodation chambers 34 from the front, as shown in FIG. 8. The pairs of resilient contact pieces 86, 87 resiliently contact the tabs 95 while sandwiching the tabs 95, and the mating terminals and the terminal bodies 51 are connected conductively. When the resilient contact pieces 86, 87 are resiliently deformed to sandwich the tabs 95, tip parts thereof respectively enter the cutout portions 65, 66. In this way, the interference of the resilient contact pieces 86, 87 with the boxes 60 can be avoided.

The connector 100 of the first embodiment is configured such that the upper and lower closing portions 41, 41 for individually closing the openings 35 on the upper surface and the openings 35 on the lower surface are formed integrally in the front member 40 to be assembled with the holding member 30 from the front. Thus, as compared to a configuration using plural individual members for respectively closing the openings 35 on the upper and lower surfaces, it is sufficient to use only the front member 40, which is a single member, and the number of components can be reduced.

The holding member 30 includes the side walls 33 defining the terminal accommodation chambers 34. The side walls 33 are formed with the restricting projection portions 37 for locking the terminal fittings 50 in the terminal accommodation chambers 34 to restrict the withdrawal of the terminal fittings 50 from the openings 35. Accordingly, the withdrawal of the terminal fittings 50 from the terminal accommodation chambers 34 before the front member 40 is assembled with the holding member 30 can be suppressed by locking the terminal fittings 50 mounted in the terminal accommodation chambers 34 by the restricting projections 37 to restrict the withdrawal from the openings 35.

The restricting projections 37 are disposed to lock the front parts of the terminal fittings 50 (both left and right edge parts of the cutouts 66). According to this configuration, it is possible to restrict the escape of at least the front parts of the terminal fittings 50 from the terminal accommodation chambers 34 before the front member 40 is assembled with the holding member 30. Thus, when the front member 40 is assembled with the holding member 30 from the front, the front parts of the terminal fittings 50 will not escape from the terminal accommodation chambers 34 and interfere with the front member 40 to hinder assembling.

The front member 40 includes the left and right side plates 42, 42 connected to both left and right parts of the upper and lower closing portions 41, 41 for covering both left and right side surfaces of the holding member 30. By cutting the front member 40 forward from the rear end to form the slits 44, parts of the side plates 42 serve as the resilient locking pieces 42A resiliently deformable in the lateral direction and lockable to the holding member 30. According to this configuration, assembling resistance in assembling the front member 40 with the holding member 30 from front can be reduced by the resilient locking pieces 42A being deflected in the lateral direction.

The holding member 30 is formed with the ribs 33A for filling up the slits 44 by entering the slits 44. According to this configuration, the intrusion of external matter into the slits 44 formed in the front member 40 can be prevented with the front member 40 assembled with the holding member 30.

In this way, the resilient locking pieces 42A constituting parts of the slits can be prevented from being improperly deformed due to interference with external matter having entered the slits 44.

The front surface of the dielectric 20 is formed with the insertion holes 21 for allowing the insertion of the tabs 95 of the mating terminals into the terminal accommodation chambers 34. Each insertion hole 21 is composed of the cutout portion 36 formed by cutting the front wall 32 of the holding member 30 to communicate with the opening 35 and the recess 47 formed in the front end part of the closing portion 41.

If the insertion holes 21 formed in the front surface of the dielectric 20 are formed only by the front wall 32 of the holding member 30, the insertion holes 21 would be formed partially by elongated beams defining the insertion holes 21 and the openings 35 and the beam portions may be broken. As a countermeasure against this, parts (recesses 47) of the insertion holes 21 closest to the openings 35 are formed by the closing portions 41. This eliminates the need for leaving the elongated beam portions in the holding member 30 and solves a problem of breakage.

Second Embodiment

FIGS. 16 to 20 show a second embodiment. The second embodiment differs from the first embodiment in the structures of a holding member 30 and a front member 40, but the other configuration is similar to that of the first embodiment. Thus, the same or equivalent structural elements as or to those of the first embodiment are denoted by the same reference signs and repeated description is omitted below.

Figure 17:
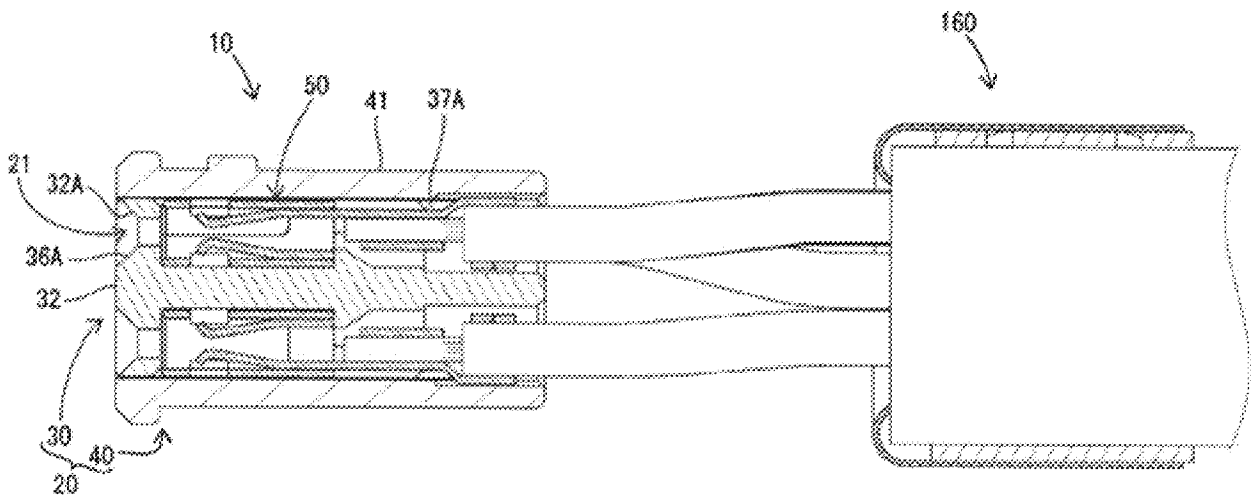
FIG. 17 is a side view in section of the terminal unit and the cable.
Figure 18:
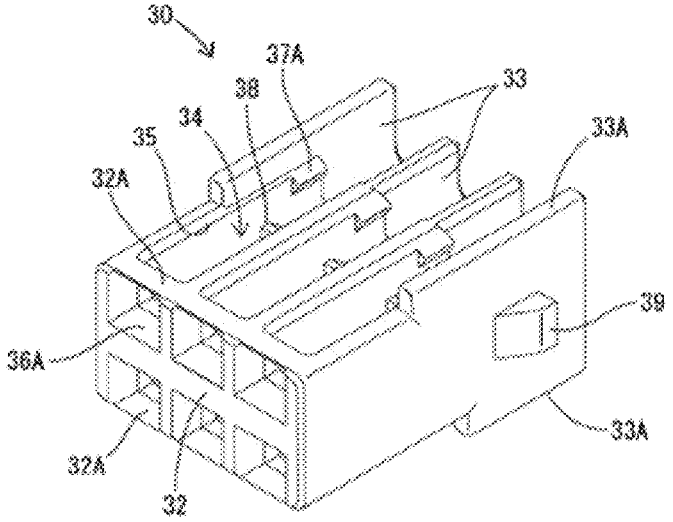
FIG. 18 is a perspective view of a holding member.
Figure 19:
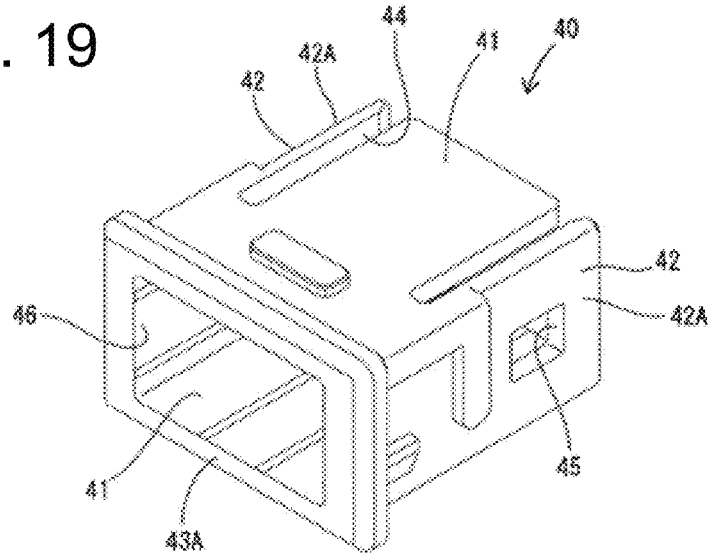
FIG. 19 is a perspective view of a front member.
Figure 20:
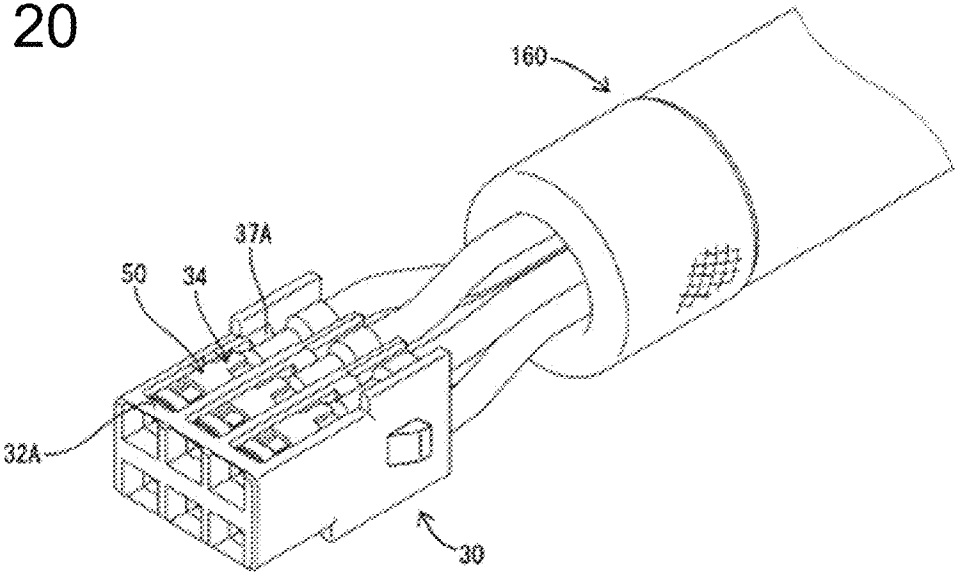
FIG. 20 is a perspective view showing a state where terminal fittings are mounted in the holding member when viewed obliquely from above.

In the case of the second embodiment, edges of insertion holes 21 formed in the front surface of a dielectric 20 are formed only by a front wall 32 of the holding member 30, as shown in FIG. 17. The insertion holes 21 are formed by cutouts 36A in the form of windows formed by cutting the front wall 32 of the holding member 30 to communicate with openings 35. Upper edges of the insertion holes 21 (cutout portions 36A) on an upper stage side are formed by a beam 32A extending in the lateral direction (see FIG. 18), and lower edges of the insertion holes 21 (cutout portions 36A) on a lower stage side are formed by a beam 32A extending in the lateral direction (see FIG. 18). The openings 35 of the holding member 30 are formed by the beams 32A and side walls 33, as shown in FIG. 18. As shown in FIG. 19, the front member 40 is not formed with recesses 47 constituting the insertion holes 21. Restricting projections 37A of the holding member 30 are formed on the side walls 33 to be locked to crimping portions 70 of terminal fittings 50 from above.

Figure 16:
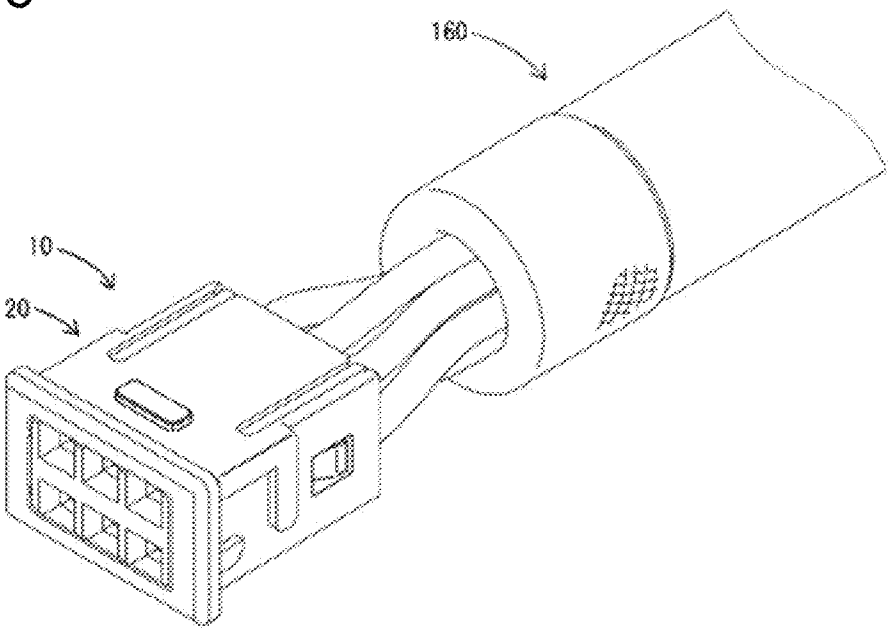
FIG. 16 is a perspective view of a terminal unit and a part of a cable of a second embodiment.

Also in the configuration of the second embodiment, the front member 40 is assembled from the front with the holding member 30 having the terminal fittings 50 mounted therein, as in the first embodiment as shown in FIG. 16, to form a terminal unit 10. The front member 40 is formed integrally with upper and lower closing portions 41, 41 for individually closing the openings 35 on an upper surface and the openings 35 on a lower surface. Thus, as compared to a configuration using a plurality of individual members for respectively closing the openings 35 on the upper and lower surfaces from the upper surface and lower sides, it is sufficient to use only the front member 40, which is a single member, and the number of components can be reduced.

Other Embodiments

The invention is not limited to the above described and illustrated embodiments. For example, the following embodiments also are included in the scope of the invention.

In the first and second embodiments, less than or more than three terminal accommodation chambers 34 in the upper stage and less than or more than three terminal accommodation chambers 34 in the lower stage may be provided in the housing 30.

In the first and second embodiments, the restricting projections 37A of the holding member 30 may be formed to lock parts of the terminal fittings 50 (intermediate parts, etc.) other than the front parts (both left and right edges of the cutouts 66) and rear parts (crimping portions 70) of the terminal fittings 50.

In the first and second embodiments, the slits of the front member 40 may be formed in the closing portions 41 or in the side plates 42 without being limited to the boundary parts between the closing portions 41 and the side plates 42 (four corner parts of the front member 40).

LIST OF REFERENCE SIGNS

21 . . . insertion hole
30 . . . holding member
32 . . . front wall
33 . . . side wall
33A . . . rib
34 . . . terminal accommodation chamber
35 . . . opening
36, 36A . . . cutout
37, 37A . . . restricting projection
40 . . . front member
41 . . . closing portion
42 . . . side plate
42A . . . resilient locking piece
44 . . . slit
47 . . . recess
50 . . . terminal fitting
90 . . . wire
95 . . . tab
100 . . . connector

The invention claimed is:

1. A connector, comprising:

terminal fittings having wires connected to rear end parts; and a dielectric for accommodating the terminal fittings with the wires drawn out rearward, wherein:

the dielectric includes:

a holding member having terminal accommodation chambers separated in upper and lower stages and laterally arranged in parallel, upper and lower surfaces of the holding member being formed with openings enabling the terminal fittings to be mounted into the terminal accommodation chambers; and a front member integrally formed with upper and lower closing portions for individually closing the openings on the upper surface and the openings on the lower surface, the front member being assembled with the holding member from a front of the holding member, the front member includes left and right side plates connected to both left and right end parts of the upper and lower closing portions for covering both left and right side surfaces of the holding member, the front member is cut forward from a rear end to form a slit, whereby a part of the side plate portion serves as a resilient locking piece resiliently deformable in a lateral direction and lockable to the holding member, and the slit is formed in a boundary between the closing portion and the side plate.

2. The connector of claim 1, wherein:

the holding member includes side walls defining the terminal accommodation chambers, and the side walls are formed with restricting projections for locking the terminal fittings in the terminal accommodation chambers to restrict withdrawal from the openings.

3. The connector of claim 2, wherein the restricting projections are disposed to lock front end parts of the terminal fittings.

4. The connector of claim 3, wherein the holding member is formed with a rib for entering and filling up the slit the slit.

5. A connector, comprising:

terminal fittings having opposite front and rear end spaced apart along a front-rear direction, wires connected to rear end parts; and a dielectric for accommodating the terminal fittings with the wires drawn out rearward, wherein:

the dielectric includes:

a holding member having terminal accommodation chambers separated into upper and lower stages and being arranged laterally arranged in parallel in the upper and lower stages, upper and lower surfaces of the holding member being formed with openings enabling the terminal fittings to be mounted into the terminal accommodation chambers; and a front member integrally formed with upper and lower closing portions for individually closing the openings on an upper surface of the holding member and the openings on a lower surface of the holding member, the front member being assembled with the holding member from a front of the holding member, a front surface of the dielectric is formed with insertion holes for allowing insertion of tabs of mating terminals into the terminal accommodation chambers, and each of the insertion holes is composed of:

a cutout in a front wall of the holding member, the cutouts extending through the front wall in the front-rear direction to communicate respectively with the openings in the holding member, the cutouts in the front wall of the holding member further being open in a direction transverse to the front-rear direction; and a recess formed in a front end part of the closing portion, each of the recesses extending through the front end part of the closing portion and being open in the direction transverse to the front-rear direction, wherein each of the cutouts is opposed to one of the recesses in the direction transverse to the front-rear direction so that one circumferential part of each of the insertion holes in the front surface of the dielectric is formed by one of the cutouts and a second circumferential part is formed by one of the recesses.

6. The connector of claim 1, wherein the holding member is formed with a rib for entering and filling up the slit the slit.

7. The connector of claim 5, wherein the front wall of the holding member has a front surface, and the end front part of the closing portion has a front surface, the front surface of the holding member and the front surface of the closing portion being aligned with one another and collectively forming the front surface of the dielectric.

* * * * *